United States Patent [19]

Grove

[11] Patent Number: 4,679,614

[45] Date of Patent: Jul. 14, 1987

[54] APPARATUS FOR SIGNIFICANTLY DECREASING UNDESIRED VARIATION IN THE ALIGNMENT OF ADJUSTABLE CONTINUOUS CASTER MOLD WALLS

[75] Inventor: John A. Grove, Sugarcreek Borough, Pa.

[73] Assignee: United States Steel Corporation, Pittsburgh, Pa.

[21] Appl. No.: 791,636

[22] Filed: Oct. 25, 1985

[51] Int. Cl.[4] ..... B22D 11/04; B22D 11/10

[52] U.S. Cl. ..... 164/436; 164/491

[58] Field of Search ..... 164/491, 436; 74/471 R

[56] References Cited

U.S. PATENT DOCUMENTS

| | | | |
|---|---|---|---|
| 3,292,216 | 12/1966 | Colombo | 22/57.2 |
| 3,375,865 | 4/1968 | Boichenko et al. | 164/436 |
| 3,439,736 | 4/1969 | Strohschein et al. | 164/273 |
| 3,710,843 | 1/1973 | Murakami et al. | 164/82 |
| 3,926,244 | 12/1975 | Meier et al. | 164/491 |
| 3,964,727 | 6/1976 | Gladwin | 249/158 |
| 4,270,593 | 6/1981 | Bachner | 164/82 |
| 4,355,733 | 10/1982 | Schoenkopf et al. | 74/471 R |

*Primary Examiner*—Nicholas P. Godici
*Assistant Examiner*—Samuel M. Heinrich
*Attorney, Agent, or Firm*—William F. Riesmeyer, III

[57] ABSTRACT

Improvements are provided in a continuous caster mold for preventing undesired variation in the angular alignment of the narrow mold walls during casting. In one aspect, an improvement is provided in a mechanism for adjusting the spacing and angular alignment of the mold wall so as to enhance the rigidity thereof. An elongated rigidly mounted housing is provided with a slidable member extending through an opening in the housing and connected to the mold wall. A mechanism is provided for adjusting the spacing of the walls by movement of the slidable member back and forth in the housing. A mechanism is provided extending longitudinally through the housing and slidable member for adjusting the angular alignment of the mold wall by tilting the wall about the axis of a first pivotal connection by movement of a second pivotal connection of the wall and said slidable member. In another aspect, the improvement includes a pair of pivotal attachments which permit sufficient rotation of the wall to various desired angular alignments with respect to the casting direction while preventing any substantial displacement of the wall in the direction generally normal to said wall at the various angular alignments thereof.

6 Claims, 9 Drawing Figures

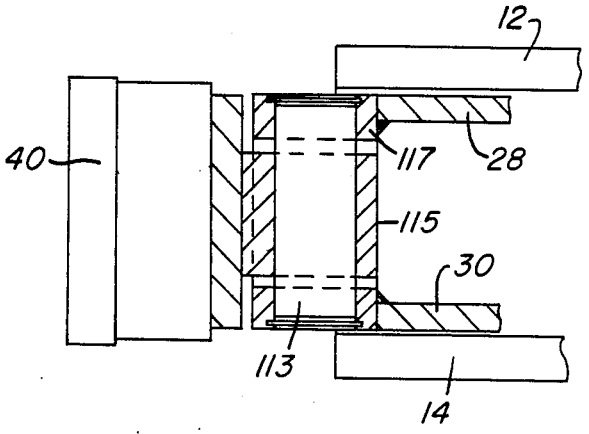
FIG. 2
FIG. 3
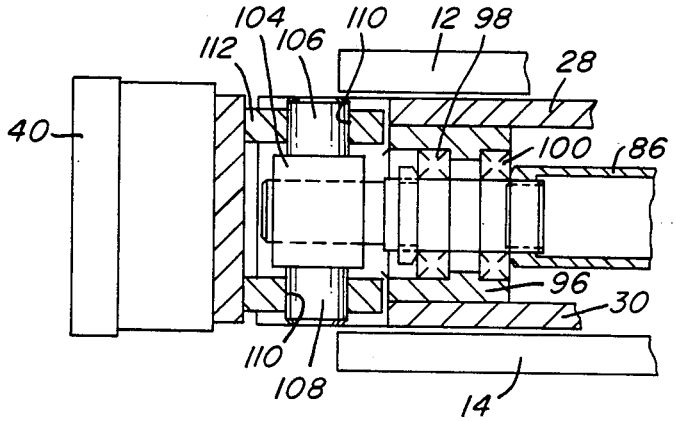
FIG. 4
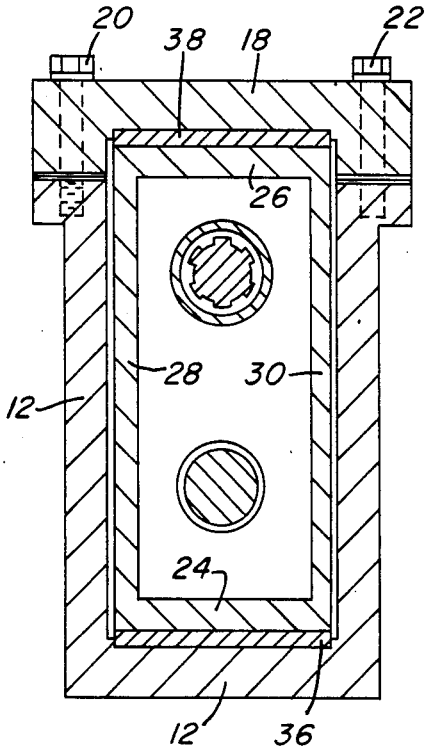
FIG. 5
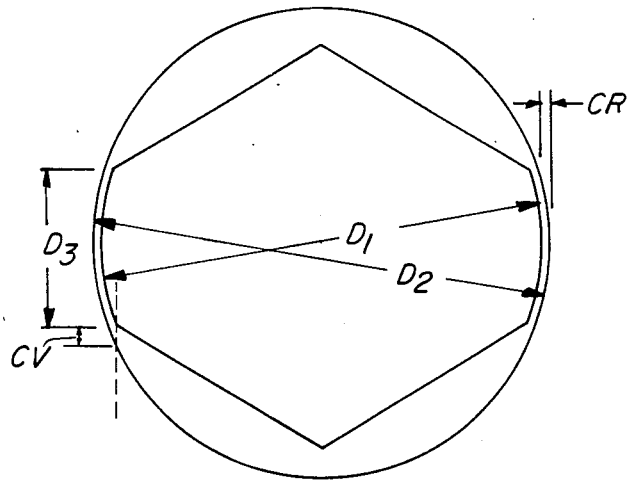

APPARATUS FOR SIGNIFICANTLY DECREASING UNDESIRED VARIATION IN THE ALIGNMENT OF ADJUSTABLE CONTINUOUS CASTER MOLD WALLS

TECHNICAL FIELD

This invention relates to an improvement in a continuous caster mold having a pair of broad walls and a pair of adjustable narrow walls therebetween. The improvement is of a method and apparatus for significantly decreasing undesired variation in the angular alignment of the narrow walls during casting.

BACKGROUND ART

Continuous caster molds for changing the width of slabs during casting are known. Typically, such molds have a pair of narrow sidewalls clamped between a pair of broad mold walls. The narrow walls are adjustable by moving one or both of them while the clamping force of the broad walls is relieved. One mechanism for adjusting the spacing and angular alignment of the narrow walls is the twin screw design in which a pair of threaded spindles are attached to each wall at spaced locations. The spindles may be mounted in a fixed housing in which case adjustment of angular alignment is accomplished by driving the spindles to different positions. Examples of this design are shown in U.S. Pat. Nos. 3,292,216 and 3,439,736. Or, the spindles may be mounted in a housing which is tiltable as shown in U.S. Pat. No. 4,270,593. In either case, the spacing required between the spindles and housing permits undesired variation in angular alignment of the mold wall during casting. The tendency for variation in mold wall alignment is especially pronounced when the wall is at greater distances from the housing, i.e. when the spindles extend further from the housing. Also, sufficient tolerance must be provided in the pivotal attachments connecting the spindles to the mold wall to permit the required angular tilting of the wall with respect to the casting direction. Unfortunately, these tolerances also increase the amount of undesired variation in angular alignment.

It is known to use rotatable internally threaded tubular members instead of twin screw spindles for adjusting the spacing of narrow mold walls which are not tiltable. The tubular members tend to enhance the rigidity of the system. Examples of this design are shown in U.S. Pat. Nos. 3,964,727 and 3,710,843. The latter reference shows tubular members mounted in guides referred to as "sliding surfaces" which further enhance rigidity. However, even this latter design would provide sufficient rigidity to eliminate undesired variation in the angular alignment of a tiltable wall during casting.

It is a primary object of the present invention to provide an improved mechanism for significantly decreasing undesired variation in the angular alignment of adjustable narrow walls of a continuous caster mold during casting.

It is another object of the invention to provide a method for adjusting the angular alignment of the narrow walls of a continuous caster mold so as to prevent any significant variation in the angular alignment of those walls during casting.

DISCLOSURE OF THE INVENTION

In one aspect, the invention includes an improved narrow wall adjustment mechanism having enhanced rigidity. The mechanism includes an elongated housing having an opening in one narrow end thereof. An elongated member is slidably mounted in the housing and extends outwardly through said opening toward the narrow mold wall. First and second pivotal connections are provided for connection of the slidable member to the narrow mold wall. Means are provided for moving the slidable member back and forth longitudinally. And finally, means are provided for adjusting the angular alignment of the narrow mold wall. The latter means extend longitudinally through the housing and slidable member and are connected to a rotatable member of said second pivotal connection, the narrow mold wall being pivotable about a rotatable member of said first pivotal connection. Movement of the rotatable member of said second pivotal connection back and forth in a direction generally normal to the plane of said narrow mold wall causes tilting of said wall about the axis of the first pivotal connection. In another aspect of the invention, an improved second pivotal connection is provided which includes a rotatable member and means journalling said rotatable member, which together accomplish the following functions (i) permitting pivotal movement of the rotatable member of said first pivotal connection about an axis of a rotatable member of a conventional first pivotal connection so as to allow angular adjustment of the mold wall, and (ii) preventing any substantial displacement of the rotatable member of said second pivotal connection with respect to the mold wall in a direction normal to said wall at any of the various angular alignments thereof. The restraint provided by the second pivotal connection in the direction normal to said wall prevents undesired variation in the alignment of the wall during casting. In the first pivotal connection, close tolerance is maintained between the rotatable member and journalling means so as to substantially prevent displacement of the mold wall in all directions with respect to the rotatable member and journalling means thereof. The invention includes a method for adjusting the angular alignment of the narrow walls of the continuous caster mold by performing the functions of the first and second pivotal connections just mentioned.

BRIEF DESCRIPTION OF THE DRAWINGS

FIG. 2 is a section taken at II—II of FIG. 1.

FIG. 3 is a section taken at III—III of FIG. 1.

FIG. 4 is a section at IV—IV of FIG. 1.

FIG. 5 is an enlarged side elevation view of pin 108 shown in FIG. 1.

MODES FOR CARRYING OUT THE INVENTION

Figure 1:
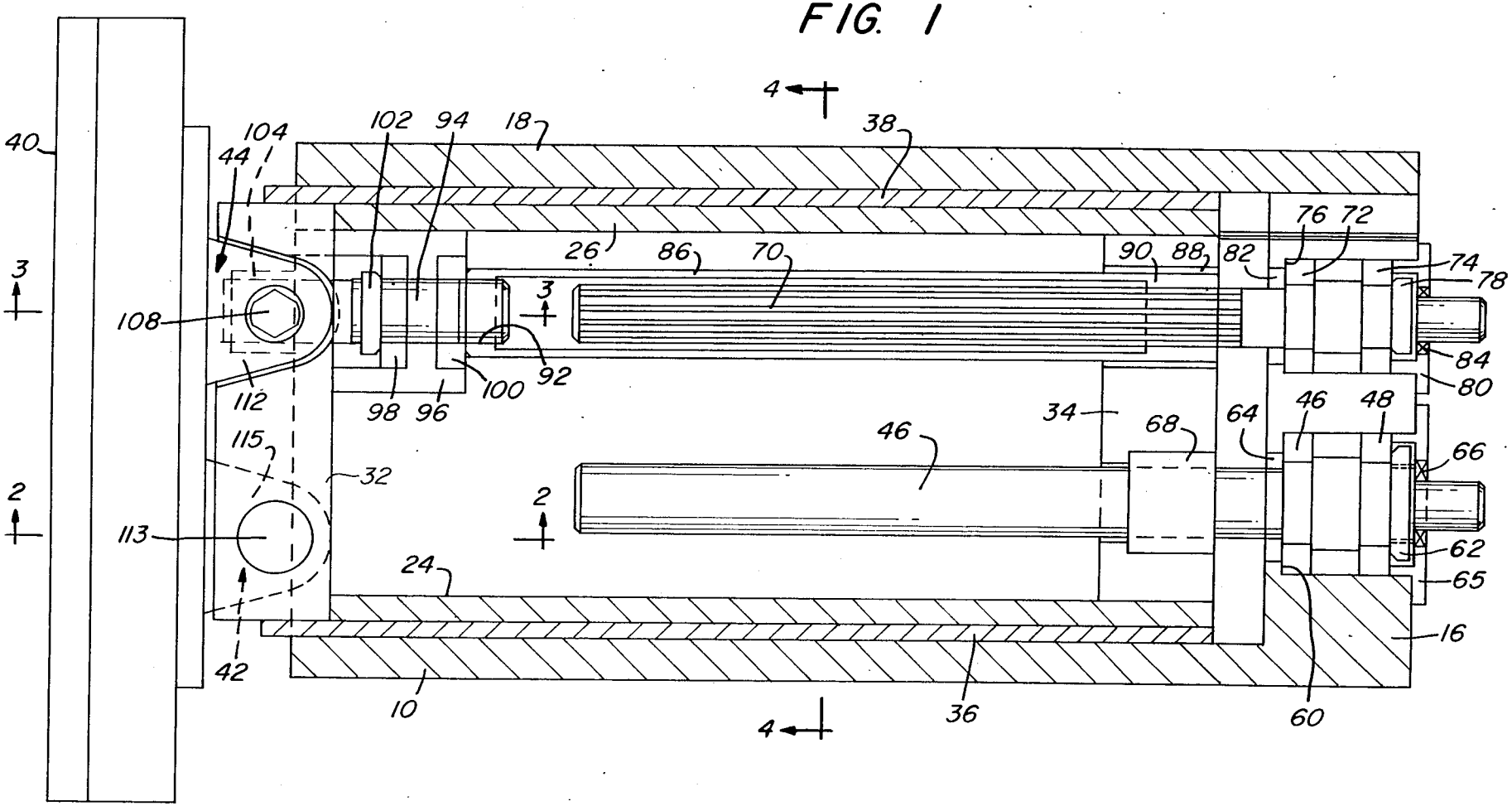
FIG. 1 is a side elevation view showing a narrow sidewall of a continuous caster mold and the improved apparatus of this invention.

A conventional continuous caster mold having a pair of broad walls and a pair of adjustable narrow walls is shown in U.S. Pat. No. 3,292,216, the specification of which is incorporated herein by reference. In one aspect of the invention, an improved mechanism is provided for adjustment of the spacing and angular alignment of the narrow mold walls. Referring to FIG. 1, the adjustment mechanism includes an elongated preferably box-shaped housing having plate 10 (FIG. 4) and spaced vertical side plates 12 and 14 extending upwardly therefrom. Plate 16 (FIG. 1) forms a back end wall for the housing. A top plate 18 (FIG. 4) is secured to the side plates by a plurality of stud bolts 20 and 22 (FIG. 4).

An elongated, preferably box-shaped member is slidably mounted in the housing and includes top and bottom plates 24 and 26 with spaced vertical side plates 28 and 30 extending therebetween. A front plate 32 closes one narrow end and back plate 34 the opposite end of the slidable member. Machined flat slide bearing members 36 and 38 are mounted on the top and bottom plates of the slidable member for guiding its movement back and forth in the housing. The bearing members enhance the rigidity of the mechanism for preventing undesired variation in the alignment of the narrow mold walls at the various spacings thereof. Alternatively, the slide bearing members may be attached to top and bottom plates of the housing. The slidable member extends through an opening in one end of the housing. It is connected to narrow mold wall 40 by a pair of pivotal connections 42 and 44 to be described subsequently herein. Means for adjusting the spacing of the narrow mold walls includes threaded screw shaft 46 having an unthreaded end portion rotatably mounted in bearing rings 48 and 50 in the back end wall of the housing. The shaft extends outwardly through said back end wall of the housing and is adapted for connection to rotatable drive means (not shown). The shaft and bearings are secured against a flange surface 60 of the back end wall by lock nut 62. A retainer 65 is press fit into the back end wall. Oil seal rings 64 and 66 close off the space between the shaft and the end wall and retainer ring, respectively. The threaded portion of screw shaft 46 extends through an internally threaded nut 68 secured in back plate 34 of the slidable member. Similarly, a splined shaft 70 has an unsplined portion rotatably mounted in bearing rings 72 and 74 in the back end wall of the housing. The unsplined portion extends outwardly of the back end wall for connection with rotatable drive means (not shown). Again, the splined shaft and bearings are pressed against flange surface 76 of the back end wall by locknut 78. A retainer 80 is press fit into the back end wall. Oil seal rings 82 and 84 close off the space between the shaft and the end wall and retainer ring, respectively. A hollow drive shaft 86 is rotatably mounted in a bushing 88 press fit into back plate 34 of the slidable member. Shaft 86 has an internally splined portion 90 at one end mounted on the mateable externally splined portion of shaft 70. The opposite end of shaft 86 has an internally threaded portion 92 mounted on a tnreaded end of shaft 94. Shaft 94 has an unthreaded portion rotatably mounted in a shaft housing section 96 secured to front plate 32. Shaft 94 has bearing rings 98 and 100 mounted thereon. The bearing rings are pressed against the opposed flange surface of the housing section by locknut 102 and shaft 94, respectively. Shaft 94 is connected to an improved pivotal connection 44 which is another aspect of the present invention. A threaded portion of shaft 94 extends through nut 104 (FIG. 3) which has opposed pin end portions 106 and 108 mounted in mateably aligned bores 110 of clevis 112. Clevis 12 is secured to mold wall 10. The improved pivotal connection 44 also helps prevent undesired variation in the angular alignment of the narrow mold walls from occurring during casting while permitting adjustment of the angular alignment of said walls to various tilted positions with respect to the casting direction. This is accomplished in one embodiment by pin end portions 106 and 108 which are of modified diamond shaped cross section (see FIG. 5). The diameter $D_2$ of clevis bore 110 for a typical mold is 5.0851 centimeters and the diameter $D_1$ of pin end portion 106 is 5.08 centimeters. The distance $D_3$ across the rounded portion of the pin is one-third of $D_1$. The tapered straight sides of the pin make an angle of about 30 degrees with the horizontal direction as shown. The spacing $C_v$ is, 0.0762 millimeters whereas $C_R$ is 0.0254 millimeters in this typical illustration of the design. $C_V$ stands for the clearance in a vertical direction between the pin and bore at the intersection of the rounded portions of the pin with its tapered straight sides when the axes of the pin and bore are coincident as illustrated in FIG. 5. Similarly, $C_R$ stands for the clearance in a radial direction between the pin and bore when the axes of the pin and bore are coincident, also as ilustrated in FIG. 5. The tapered straight sides of the pin with relatively large spacing from the bore allow movement of the pin in a very small circular arc within the clevis bore as necessary for tilting of the mold wall. However, the close tolerance spacing of the rounded portions of the pin in the bore impose a restraint on movement of the pin in the direction normal to the face of the mold wall and restrict variation of the wall from its desired angular alignment during casting. The conventional pivotal connection 42 (FIGS. 1 and 2) includes a cylindrical pin 113 mounted in mateably aligned cylindrical bores of yoke 115 secured to the mold wall and clevis 117 secured to the slidable member. The pin fits with close tolerance in the bores, the tolerance being within a range of 0.0127–0.127 mm.

Figure 7:
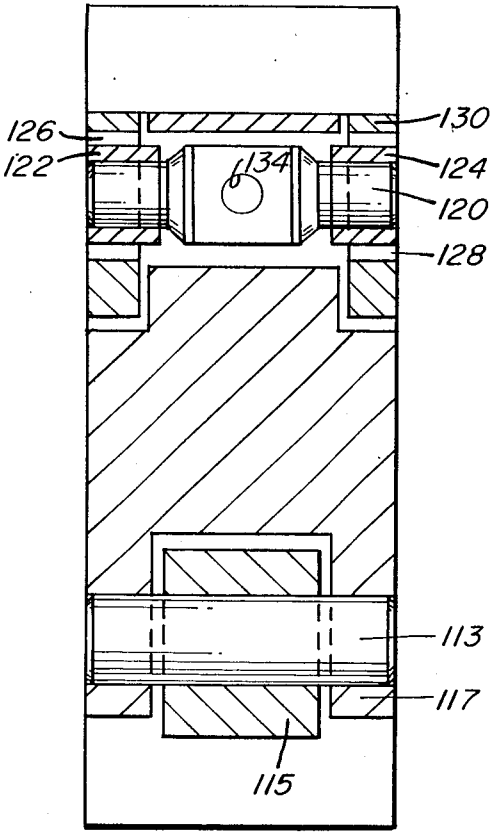
FIG. 7 is a section taken at VII—VII of FIG. 6.
Figure 6:
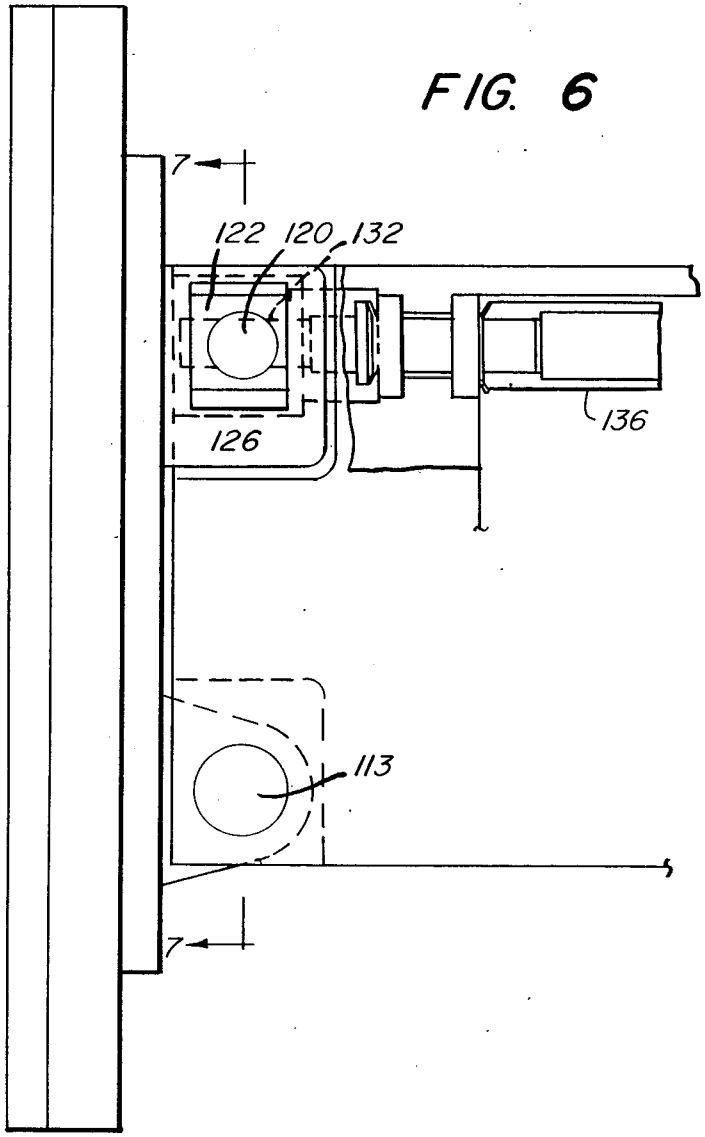
FIG. 6 is a side elevation view of an alternative embodiment of the invention.

Referring to FIGS. 6 and 7 an alternate embodiment of the improved pivotal connection of this invention includes pin 120 journalled in a pair of slidable members 122 and 124. The members 122 and 124 are slidably mounted in slots 126 and 128 of clevis 130. Threaded spindle 132 engaged in a threaded bore 134 of the pin 120 is rotatably driven by drive shaft 136 for moving the upper end of the mold wall back and forth independently of its lower end. This serves to adjust the angular alignment of the narrow mold wall. Clevis 130 attached to the mold wall tilts, permitting up and down movement of the slidable members in the slots 126 and 128, to accommodate angular movement of the mold wall while pin 120 is retained in a fixed horizontal plane.

Figure 9:
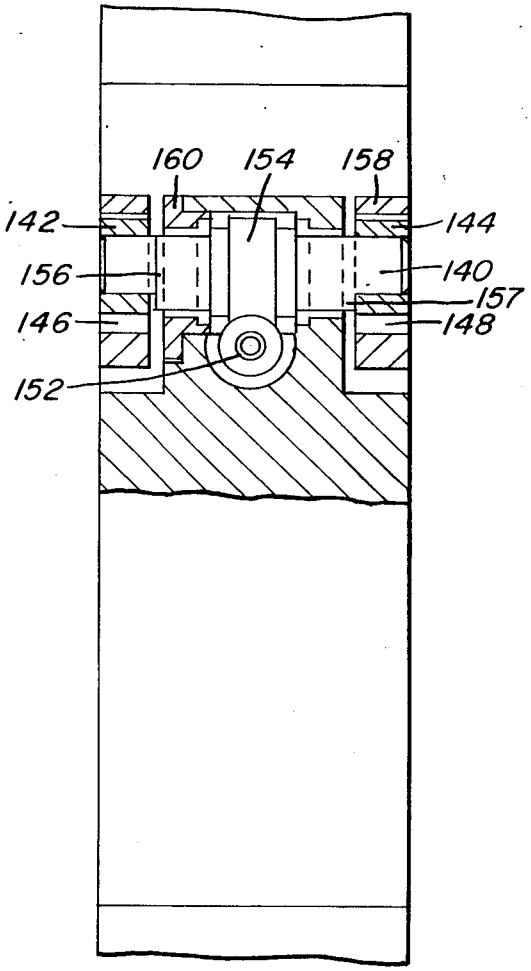
FIG. 9 is a section taken at IX—IX of FIG. 8.
Figure 8:
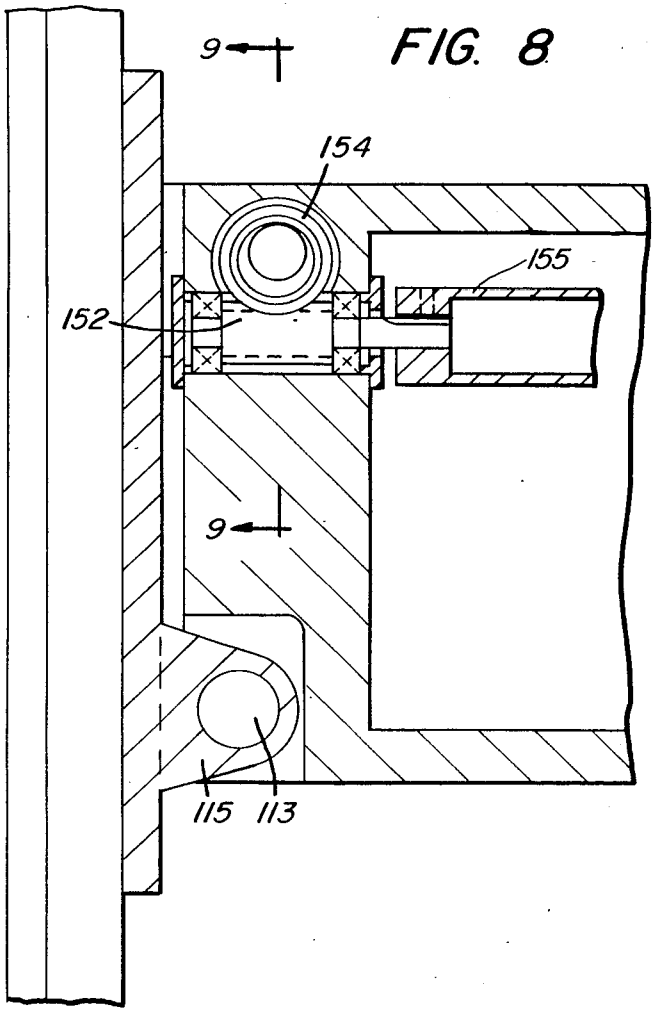
FIG. 8 is a side elevation view of another alternative embodiment of the invention.

Referring to FIGS. 8 and 9 another alternative embodiment is shown in which the improved pivotal connection of this invention includes a pin 140 journalled in a pair of slidable members 142 and 144. The members 142 and 144 are slidably mounted in slots 146 and 148 of clevis 158 similar to the alternate embodiment mentioned above. In this embodiment, a worm gear 152 engages helical gear 154 centrally mounted on pin 140. The worm gear is rotatably driven by drive shaft 155 in similar fashion to the alternate embodiment above-mentioned for moving the upper end of the narrow mold wall independently of its lower end. In this case, up and down movement of the slidable members in the slots 146 and 148 is assisted by a crank arm effect provided by offset cylindrical portions 156 and 157 of pin 140 which are journalled in housing 160 of the adjustment mechanism for the mold wall. Any of the improved pivoted connections just described may be used with a conventional adjustment mechanism, for example, the type shown in U.S. Pat. No. 3,710,843, the specification of which is incorporated herein by reference.

In operation, the narrow mold walls are moved to their desired spacing with respect to each other by the adjustment mechanism through rotation of threaded screw shaft 54 which moves the slidable member back and forth in the housing. The angular alignment of the narrow mold walls is adjusted, by moving the improved pivotal connection of this invention so as to tilt said walls to the angular alignment desired. This is accomplished through rotation of splined shaft 70 causing rotation of drive shaft 86 and shaft 94 in nut 104. Rotation of shaft 94 in the nut causes movement of one end of the mold wall, tilting it with respect to the casting direction. The sequence of adjustment of the spacing and angular alignment may be interchanged, depending on whether the spacing is being increased or decreased.

Industrial Applicability

This invention is useful on continuous caster molds for converting molten metal to solidified strands of various shaped cross sections.

I claim:

1. In a continuous caster mold, said mold having broad and narrow mold walls, means for adjustment of the spacing and angular alignment of the narrow walls with respect to a casting direction, and a pair of means pivotally connecting each narrow wall to the adjustment means at spaced locations adjacent opposed ends of said wall in the casting direction, the improvement in said mold for increasing the rigidity of said adjustment means which is characterized by:

said adjustment means including an elongated housing having an opening in one narrow end thereof, an elongated member slidably mounted in the housing and extending outwardly through said opening in the housing, said pair of pivotal connections connecting the mold wall to said member, means for moving said slidable member longitudinally back and forth in the housing, and means extending longitudinally through the housing and said slidable member and connected to the rotatable member of one of said pair of pivotal connections for adjusting the angular alignment of said mold wall by tilting said wall about the axis of the other of the pivotal connections in said pair.

2. The improved apparatus of claim 1 wherein said angular alignment adjustment means is characterized by a pair of concentrically mounted telescopically slidable shafts, the adjoining inner and outer surfaces of said shafts being mateably splined, said externally splined shaft being rotatably mounted in the housing and extending outwardly to rotatable drive means, said internally splined shaft being rotatably mounted in the member slidable in said housing, and means rotatably driven by said internally splined shaft for adjusting the angular alignment of said mold wall.

3. The improved apparatus of claim 1 wherein said member and housing are characterized as having a rectangular cross section and further characterizing smooth flat bearing surfaces for guiding opposed top and bottom surfaces of said member in the housing.

4. In a continuous caster mold, said mold having opposed pairs of broad and narrow mold walls, means for adjustment of the spacing and angular alignment of the narrow walls with respect to a casting direction, and a pair of first and second pivotal connection means connecting each narrow wall to said adjustment means at spaced locations adjacent opposite ends of said wall in the direction of casting, said first and second pivotal connection means each including a member axially rotatable about an axis parallel to the narrow mold wall, said axis extending in a direction normal to the casting direction, and means for journalling said rotatable member attached to said mold wall and the adjustment mechanism, the improvement in said mold for significantly decreasing undesired variation in the angular alignment of said narrow mold walls during casting which is characterized by:

the rotatable member in said second pivotable connection means being a pin of diamond-shaped cross section and having at least one pair of opposed rounded corners, said pair of rounded corners lying in the direction essentially normal to both the narrow mold wall and the casting direction, said pin having a sufficiently smaller cross-sectional dimension in a direction parallel to the direction of casting than the cross-sectional direction in said normal direction so as to permit adjustment of the tilted angular alignment of the mold wall as desired, said journalling means having a cylindrical bore receiving the diamond-shaped pin therein.

5. In a continuous caster mold, said mold having opposed pairs of broad and narrow mold walls, means for adjustment of the spacing and angular alignment of the narrow walls with respect to a casting direction, and a pair of first and second pivotal connection means connecting each narrow wall to said adjustment means at spaced locations adjacent opposite ends of said wall in the direction of casting, said first and second pivotal connection means each including a member axially rotatable about an axis parallel to the narrow mold wall, said axis extending in a direction normal to the casting direction, and means for journalling said rotatable member attached to said mold wall and the adjustment mechanism, the improvement in said mold for significantly decreasing undesired variation in the angular alignment of said narrow mold walls during casting which is characterized by:

the rotatable member in said second pivotable connection means having a body portion and mateably aligned opposed cylindrical end portions having an axis offset from the axis of the body portion, and wherein said journalling means comprises a pair of members slidably mounted in a direction parallel to the direction of casting, said members each having a cylindrical bore for receiving one of the opposed ends of the rotatable member therein.

6. The improved apparatus of claim 5 wherein the body portion of said rotatable member is characterized by a helical gear means axially aligned with said member and extending around the outer periphery thereof, said gear means being adapted for engagement by worm gear means for adjusting the tilted alignment of said narrow mold wall.

* * * * *